US009896286B2

(12) United States Patent
Nakayama et al.

(10) Patent No.: US 9,896,286 B2
(45) Date of Patent: Feb. 20, 2018

(54) ROLLER

(71) Applicant: HITACHI METALS, LTD., Tokyo (JP)

(72) Inventors: Ichiro Nakayama, Tokyo (JP); Kazuya Iwase, Tokyo (JP); Hiromi Funahashi, Tokyo (JP); Tsuyoshi Mitsuboshi, Tokyo (JP); Wataru Hirayama, Tokyo (JP); Tamotsu Kido, Tokyo (JP); Masayuki Shimizu, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 154 days.

(21) Appl. No.: 14/933,092

(22) Filed: Nov. 5, 2015

(65) Prior Publication Data

US 2016/0137440 A1 May 19, 2016

(30) Foreign Application Priority Data

Nov. 19, 2014 (JP) ..... 2014-234858

(51) Int. Cl.
*B65H 3/06* (2006.01)

(52) U.S. Cl.
CPC ..... *B65H 3/0638* (2013.01); *B65H 2401/111* (2013.01); *B65H 2401/15* (2013.01); *B65H 2402/80* (2013.01); *B65H 2404/113* (2013.01); *B65H 2404/1141* (2013.01); *B65H 2404/13161* (2013.01); *B65H 2404/181* (2013.01)

(58) Field of Classification Search
CPC .. B65H 3/0638; B65H 3/0615; B65H 3/0653; B65H 3/0661; B65H 3/42; B65H 2401/111; B65H 2401/15; B65H 2404/181; B65H 2404/133; B65H 2404/1141; B65H 2404/13161; B65H 2402/80; B29C 39/12; B29C 39/123; G07D 11/0021; G07D 11/024; G07D 11/0027; G07D 11/003; G07D 11/0033; G07D 2211/00
USPC ..... 264/318, 279; 492/30, 31, 33, 34, 36; 29/895.32
See application file for complete search history.

(56) References Cited

U.S. PATENT DOCUMENTS 1,576,924 A * 3/1926 Malloy ..... B60B 37/10 152/323
2,552,987 A * 5/1951 Loertz, Jr. ..... A63C 17/0046 267/248
2,639,560 A * 5/1953 Cosmos ..... B24B 21/14 451/303
3,578,812 A * 5/1971 Taussig ..... B60B 5/02 152/379.3

(Continued)

FOREIGN PATENT DOCUMENTS

JP 10-157864 A 6/1998

*Primary Examiner* — Jason L Vaughan
(74) *Attorney, Agent, or Firm* — McGinn IP Law Group, PLLC.

(57) ABSTRACT

There is provided a roller including: a roller body part; and a rubber part attached to the roller body part, the rubber part including: a rubber body part provided on an outer circumference of the roller body part; and a side extending part extending on a side face of the roller body part from a side face of the rubber body part, wherein the roller body part has a recess portion formed on the side face of the roller body part, and into which the side extending part is fitted.

4 Claims, 5 Drawing Sheets

(56) References Cited

U.S. PATENT DOCUMENTS 3,626,774 A * 12/1971 Schon ..... F16H 55/34 16/45
3,843,202 A * 10/1974 Lacerte ..... B60B 33/0028 152/380
4,217,944 A * 8/1980 Pascal ..... B29D 30/02 152/323
4,447,093 A * 5/1984 Cunard ..... B29C 45/1676 152/323
4,535,827 A * 8/1985 Seaford ..... B29C 45/14491 152/323
4,560,154 A * 12/1985 Nogi ..... B65H 3/063 271/10.16
4,567,633 A * 2/1986 Corkery ..... B29C 45/1459 264/267
4,682,393 A * 7/1987 Corkery ..... B29C 45/1459 301/64.702
4,879,794 A * 11/1989 Djerf ..... B60B 5/02 264/263
5,224,642 A * 7/1993 Davis ..... B65B 41/16 226/190
5,573,309 A * 11/1996 Bekessy ..... A63C 17/223 280/11.223
5,687,963 A * 11/1997 Mennie ..... B65H 3/063 271/119
5,790,697 A * 8/1998 Munro ..... B65H 3/063 209/546
5,979,992 A * 11/1999 Calderone ..... A63C 17/223 152/323
5,996,775 A * 12/1999 Hendrickx ..... B65H 27/00 198/722
6,136,143 A * 10/2000 Winter ..... B24D 5/16 15/3.53
6,186,490 B1 * 2/2001 Sugiura ..... B65H 3/0638 271/10.09
6,655,747 B2 * 12/2003 Young ..... A63C 17/22 301/5.301
7,458,573 B2 * 12/2008 Park ..... B65H 3/0653 271/122
9,340,381 B2 * 5/2016 Matsushita ..... B65H 5/068
2013/0075234 A1 * 3/2013 Ishibashi ..... B65H 27/00 198/780

* cited by examiner

ROLLER

BACKGROUND

Technical Field

The present invention relates to a roller for example used for a paper sheet separation mechanism.

Description of Related Art

A roller is used for a paper sheet separation mechanism, etc. Such a roller employs a structure in which a rubber part is attached to a roller body part (for example, see patent document 1).

The roller described in patent document 1 is configured to hold the rubber part in the roller body part by receiving a rubber piece in a notch of the roller body part, into which the rubber part is fitted, and the rubber piece having a larger dimension than the notch, without using an adhesive agent.

Patent document 1: Japanese Patent Laid Open Publication No. 1998-157864

SUMMARY OF THE INVENTION

However, in the structure described in patent document 1, the rubber part and the roller body part are in contact with each other only in the notch, thus involving a problem that the rubber part falls off from the roller body part during use of the roller.

An object of the present invention is to provide the roller capable of suppressing the fall-off of the rubber part from the roller body part during use of the roller.

According to an aspect of the present invention, there is provided a roller, comprising:

a roller body part; and a rubber part attached to the roller body part, the rubber part comprising:

a rubber body part provided on an outer circumference of the roller body part; and a side extending part extending on a side face of the roller body part from a side face of the rubber body part, wherein the roller body part has a recess portion formed on the side face of the roller body part, and into which the side extending part is fitted.

By fitting the side extending part of the rubber part into the recess portion on the side face of the roller body part, displacement or detachment of the rubber part is suppressed.

DETAILED DESCRIPTION OF THE INVENTION

A roller 10 according to an embodiment of the present invention, will be described, with reference to FIG. 1A to FIG. 1E. The roller 10 of this embodiment is preferably used in a paper sheet separation mechanism for example, for conveying accumulated paper sheets such as integrated banknotes and securities, etc., by separating them one by one. Here, the roller 10 used as a feed roller of the paper sheet separation mechanism is given as an example, for the explanation to proceed.

Figure 1A:
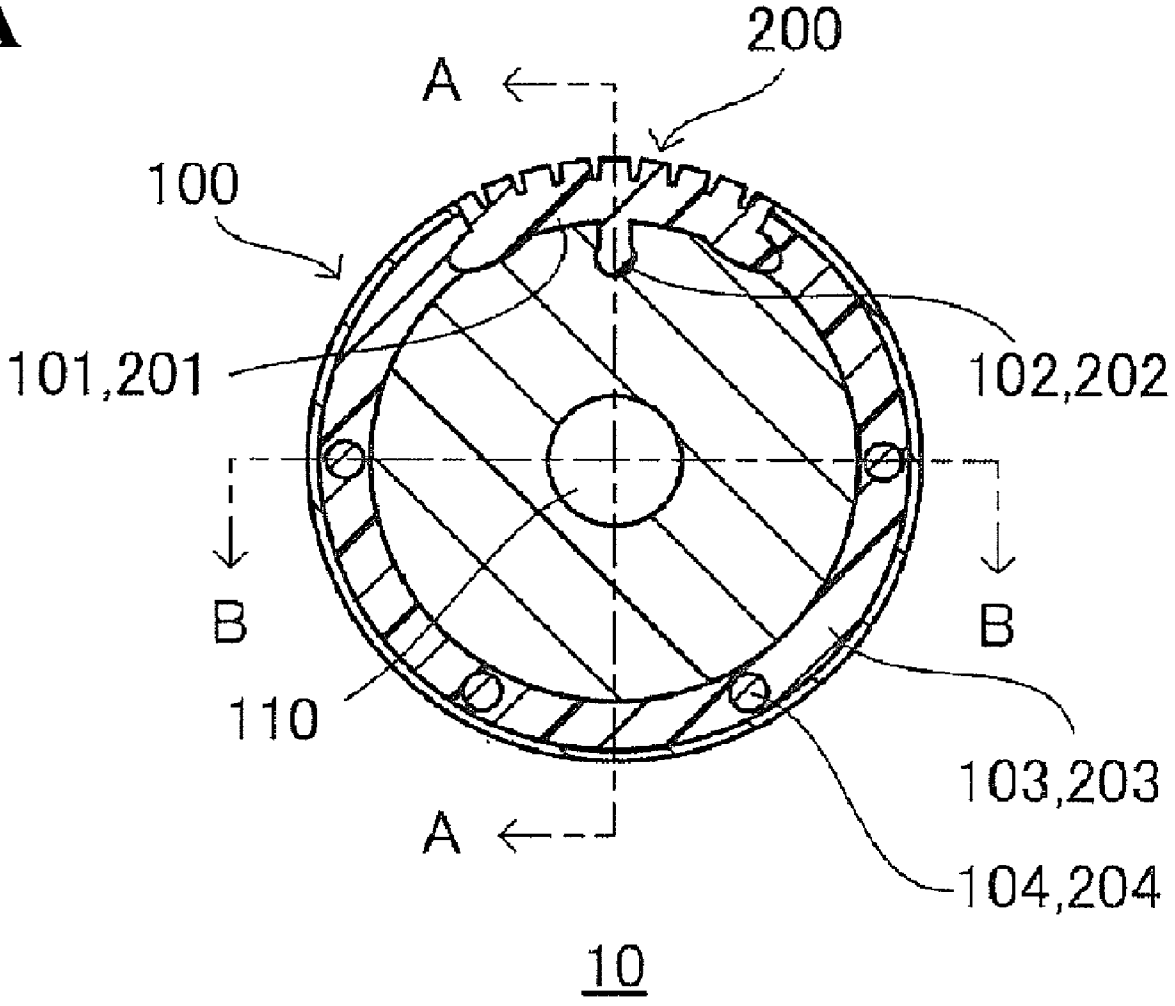
FIG. 1A is a schematic left side view of a roller according to an embodiment of the present invention.
Figure 1B:
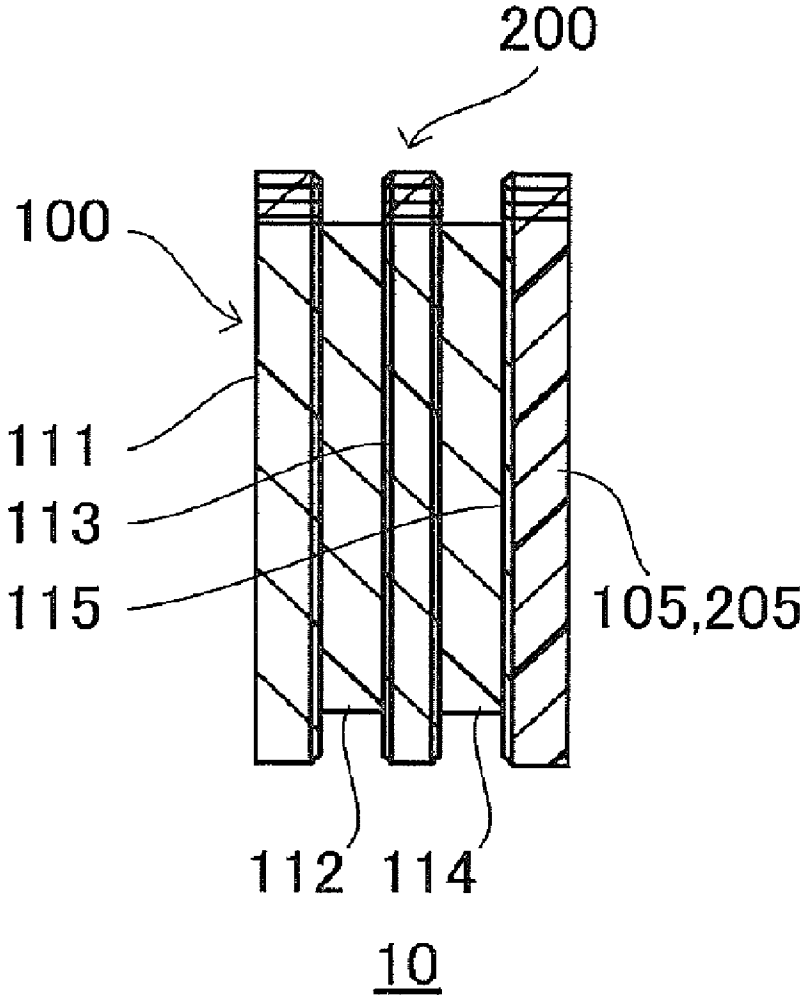
FIG. 1B is a schematic front view of the roller according to an embodiment of the present invention.
Figure 1C:
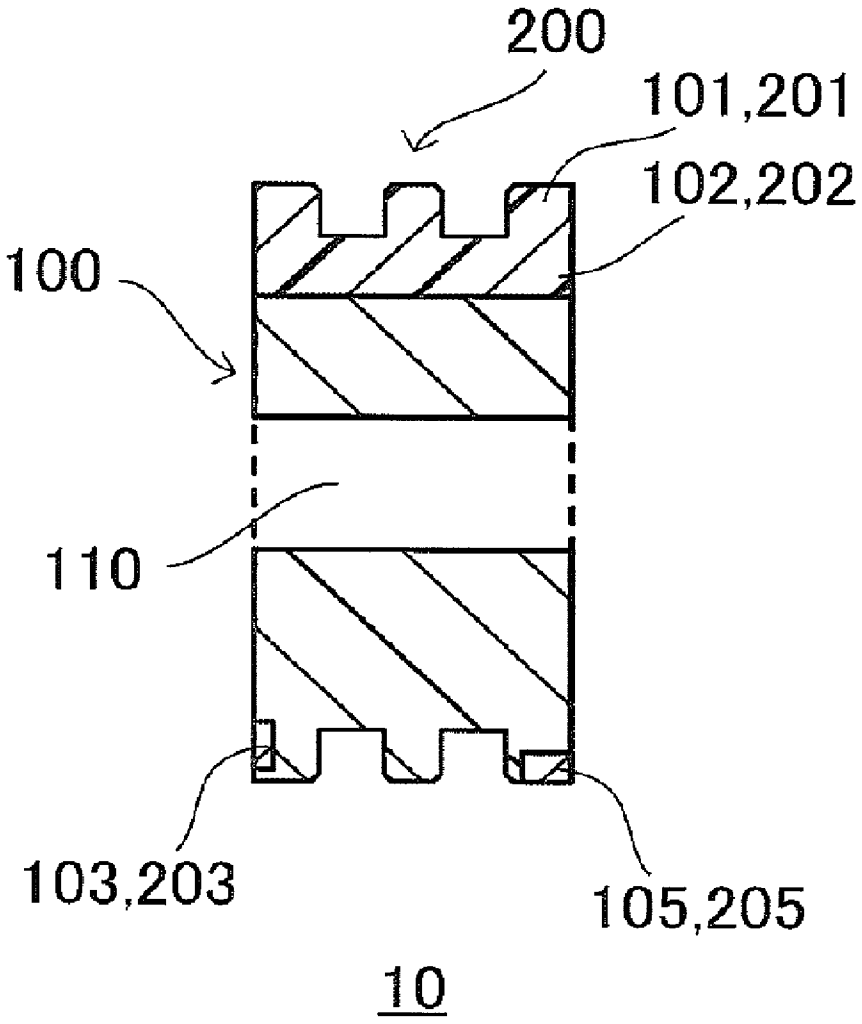
FIG. 1C is a schematic cross-sectional view taken along line AA shown in FIG. 1A and FIG. 1D.
Figure 1D:
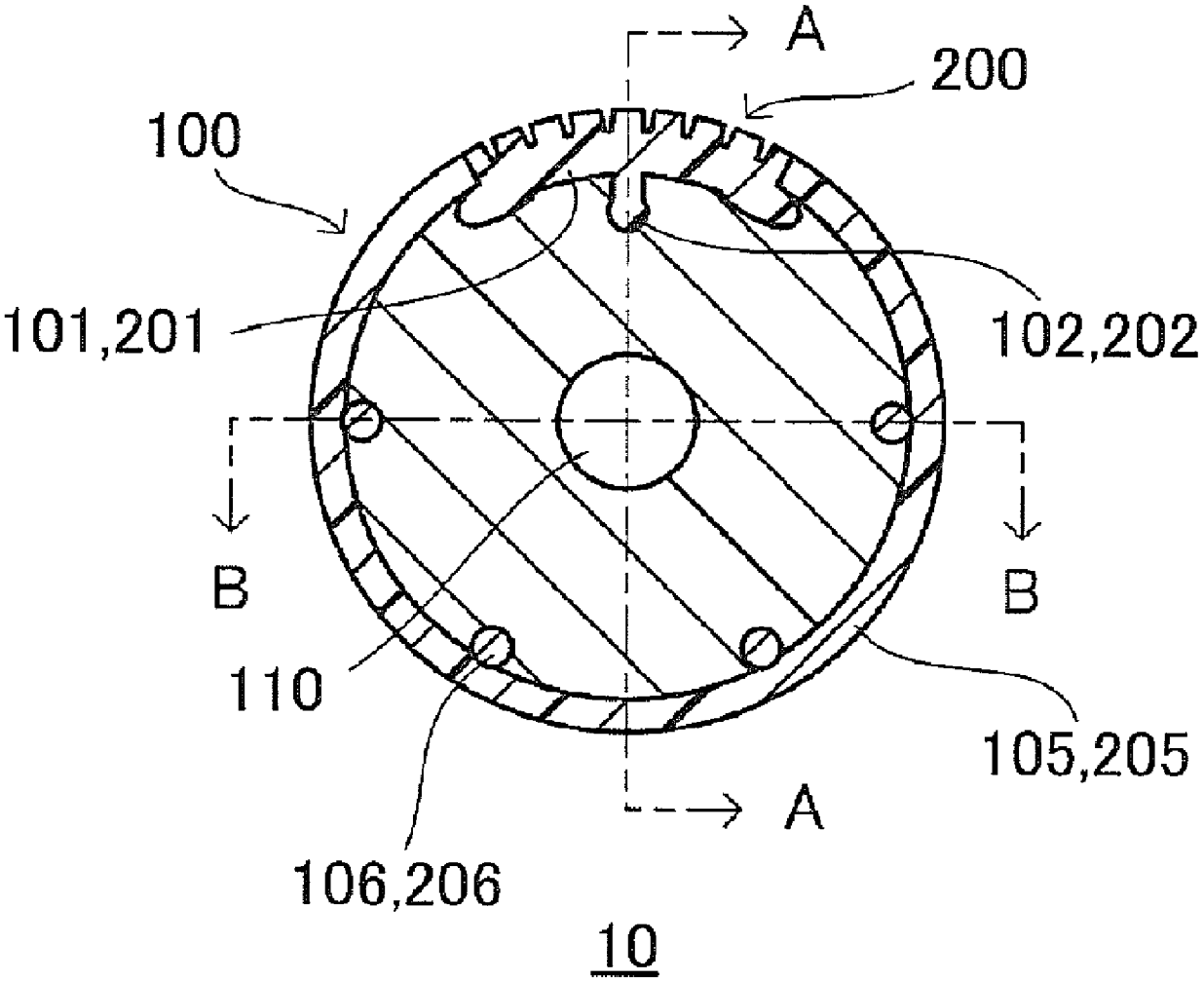
FIG. 1D is a schematic right side view of the roller according to an embodiment of the present invention.
Figure 1E:
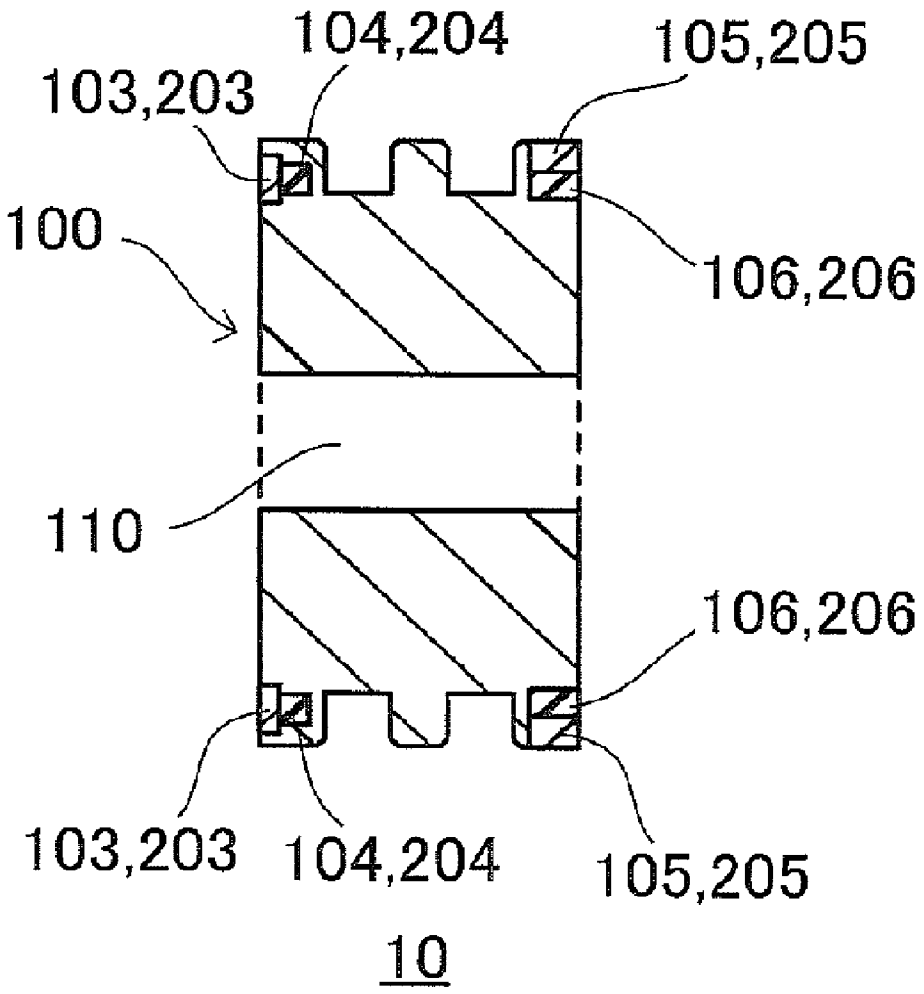
FIG. 1E is a schematic cross-sectional view taken along line BB shown in FIG. 1A and FIG. 1D.

FIG. 1A, FIG. 1B, and FIG. 1D are respectively a schematic left side view, front view, and right side view of the roller 10. FIG. 1C and FIG. 1E are respectively a schematic cross-sectional view taken along the line AA and a schematic cross-sectional view taken along the line BB shown in FIG. 1A and FIG. 1D.

A structure of the roller 10 will be described first. The roller 10 is constituted of a roller body part (metal core) 100, and a rubber part 200 attached to the roller body part 100. In order to facilitate the illustration, in FIG. 1A to FIG. 1E, the roller body part 100 is denoted by a left-upward hatching, and the rubber part 200 is denoted by a right-upward hatching.

The roller body part 100 is made of a metal material such as an aluminum alloy for example, and has approximately a cylindrical shape, with a through hole 110 in the center so that a shaft can pass therethrough. A circumferential direction, a radial direction and a thickness direction of the roller body part 100 (or the roller 10) are sometimes simply called the circumferential direction, the radial direction, and the thickness direction.

The whole body of the rubber part 200 is integrally formed using a rubber material (such as polyurethane, etc.) in a shape of being fitted into the roller body part. The roller body part 100 and the rubber part 200 are not fixed to each other by an adhesive agent. That is, the roller body part 100 and the rubber part 200 are in contact with each other not through the adhesive agent.

In this specification, the expression "the rubber part 200 is fitted into the roller body part 100", etc., does not mean a fabrication method such that "the rubber part 200 formed as a separate body from the roller body part 100, is fitted into the roller body part", but mean a shape in which "the rubber part 200 is fitted into the roller body part 100". As will be described later in detail, the rubber part 200 of this embodiment is molded into a shape fitted into the roller body part 100 by pouring the rubber material over the roller body part 100 which is a part of a mold.

The rubber part 200 is roughly divided into a rubber body part (feed rubber) 201, a side extending part 203, and an outer circumferential part 205. The rubber body part 201 is provided on a part of an outer circumference of the roller body part 100 (one portion in a circumferential direction), over the entire thickness of the roller body part 100. The rubber body part 201 has a higher coefficient of friction against a conveyed paper sheet than the roller body part 100, and feeds the paper sheet in contact with the paper sheet on the outer circumference, with a rotation of the roller 10. A recess portion (notch) 101 having a shape corresponding to the rubber body part 201, is formed on a part of the outer circumference of the roller body part 100, so that the rubber body part 201 is fitted into the notch 101.

An outer circumferential shape of the rubber body part 201 can be shaped into an uneven shape (tooth form) as needed. By shaping the outer circumferential shape of the rubber body part 201 into the uneven shape, adhesion of a paper powder to the rubber body part 201 can be suppressed, thus suppressing a reduction of a frictional force.

The rubber body part 201 has a protrusion 202 that protrudes to the inside (radial direction side or circumferential direction side) of the roller body part 100. A portion other than the protrusion 202 in the rubber body part 201, is referred to as a main part of the rubber body part 201. A recess portion (hole) 102 having a shape corresponding to the protrusion 202, is formed on an inner surface of the notch 101, so that the protrusion 202 is fitted into the hole 102. Owing to the protrusion 202, the rubber body part 201 is hardly deviated to outside in the radial direction or in the thickness direction. Thus, an effect of suppressing the deviation or fall-off of the rubber body part 201 from the roller body part 100, can be obtained. The protrusion 202 has a radially enlarged structure in which the thickness becomes larger toward the inside (radial side or circumferential side) of the roller body part 100.

The rubber part 200 has a side extending part 203 extending on a side face (on a left side face shown in FIG. 1A in this example) of the roller body part 100 from the side face of the rubber body part 201. A recess portion (groove) 103 having a shape corresponding to the side extending part 203, is formed on the side face of the roller body part 100, so that the side extending part 203 is fitted into the groove 103. The side extending part 203 is preferably formed in a ring shape and in a closed shape along the circumference of the roller body part 100.

In FIG. 1A, a border line is shown between the rubber body part 201 and the side extending part 203, to make the illustration easy to be understood. However, the side extending part 203 is formed integrally with the rubber body part 201, with no seam provided between the rubber body part 201 and the side extending part 203.

Owing to the side extending part 203 fitted into the side face of the roller main body 100, the rubber body part 201 is hardly deviated in the thickness direction, particularly to an opposite side (right side in this example) of a formation side of the side extending part 203. Also, owing to the side extending part 203, the rubber body part 201 is hardly deviated to the radial outside. Thus, the effect of suppressing the deviation or the fall-off of the rubber body part 201 from the roller body part 100, can be obtained.

It should be noted that if the side extending part 203 is formed as a portion fitted into the side face of the roller body part 100 extending from the side face of the rubber body part 201, the abovementioned effect can be obtained even if the side extending part 203 does not have a ring shape. An extending direction of the side extending part 203 on the side face of the roller body part 100, is not limited to the circumferential direction as shown in the figure. By further forming the side extending part 203 into the ring shape, the abovementioned effect can be further increased.

The side extending part 203 has a protrusion 204 protruding to the inside (thickness direction side) of the roller body part 100 from the side face side of the roller body part 100. A portion other than the protrusion 204 in the side extending part 203, is referred to as a main part of the side extending part 203. A recess portion (hole) 104 having a shape corresponding to the protrusion 204, is formed on the inner surface of the groove 103, so that the protrusion 204 is fitted into the hole 104. Owing to the protrusion 204, the rubber body part 201 is further hardly deviated to the radial outside or in the thickness direction, and the effect of further suppressing the deviation or the fall-off of the rubber body part 201 from the roller body part 100, can be obtained.

In FIG. 1A and FIG. 1E, a border line is shown between the side extending part 203 and the protrusion 204, to make the illustration easy to be understood. However, the protrusion 204 is formed integrally with the side extending part 203, with no seam provided between side extending part 203 and the protrusion 204.

The roller 10 has a structure in which small diameter parts 112 and 114 having relatively small outer diameters, are sandwiched between large diameter parts 111, 113, and 115 having relatively large diameters, and the small diameter parts 112 and 114 have valley portions. A side face of the large diameter part 111 forms one of the side faces (left side face in this example) of the roller 10, and a side face of the large diameter part 115 forms the other side face (right side face in this example) of the roller 10. The roller 10 given for example as a feed roller, is used by forming a pair with a gate roller, so that mountain portions of the gate roller are arranged in the valley portions of the feed roller.

The rubber part 200 has an outer circumferential part 205 extending on the outer circumference of the large diameter part 115 from a circumferential end portion of the rubber body part 201. In the large diameter parts 111 and 113, the circumferential outside of the rubber body part 201 is not covered with a rubber member, and meanwhile, in the large diameter part 115, the circumferential outside of the rubber body part 201 is covered with the outer circumferential part 205. The recess portion (for example notch) 105 having a shape corresponding to the outer circumferential part 205, is formed on the outer circumference of the large diameter part 115 of the roller body part 100, so that the outer circumferential part 205 is fitted into the recess portion 105.

In FIG. 1D, a border line is shown between the rubber body part 201 and the outer circumferential part 205, to make the illustration easy to be understood. However, the outer circumferential part 205 is formed integrally with the rubber body part 201, with no seam provided between the rubber body part 201 and the outer circumferential part 205.

The outer circumferential part 205 has a protrusion 206 that protrudes to the inside (radial direction side) of the roller body part 100 from the outer circumferential side of the roller body part 100. A portion of the outer circumferential part 205 other than the protrusion 206 is referred to as a main part of the outer circumferential part 205. A recess portion (hole) 106 having a shape corresponding to the protrusion 206, is formed on an inner surface of the recess portion 105, so that the protrusion 206 is fitted into the hole 106. Owing to the protrusion 206, the outer circumferential part 205 is hardly deviated to outside in the radial direction or in the thickness direction. As a result, the rubber body part 201 is hardly deviated to outside in the radial direction or in the thickness direction, and the effect of suppressing the deviation or fall-off of the rubber body part 201 from the roller body part 100, can be obtained.

In FIG. 1D and FIG. 1E, a border line is shown between the outer circumferential part 205 and protrusion 206, to make the illustration easy to be understood. However, the protrusion 206 is formed integrally with the outer circumferential part 205, with no seam provided between the outer circumferential part 205 and the protrusion 206.

A dimension of each part of the roller 10 is as follows for example. diameters of a large diameter part 111, etc., and a small diameter part 112, etc., are respectively about 45 mm and 38 mm for example. A diameter of the through hole 110 of the shaft is about 10 mm for example. A thickness of an entire body of the roller 10 is about 24 mm for example, and thicknesses of the large diameter part 111, etc., and the small diameter part 112, etc., are respectively about 4.5 mm and about 5 mm for example.

A thickness (dimension in the radial direction of the roller) of the rubber body part 201 is about 5 mm for example, and a length (dimension in the circumferential direction of the roller) of the rubber body part 201 is about 25 mm for example. Further, the thickness (dimension in the thickness direction of the roller) of the side extending part 203 is about 1 mm for example, and a width (dimension in the radial direction of the roller) of the side extending part 203 is about 3 mm for example. A depth (dimension in the thickness direction of the roller) protruded from the side extending part 203 of the protrusion 204 is about 3 mm for example, and a diameter (dimension in the radial direction of the roller) of the protrusion 204 is about 3 mm for example.

A thickness (dimension in the radial direction of the roller) of the outer circumferential part 205 is about 2 mm for example, and a width (dimension in the thickness direction of the roller) of the outer circumferential part 205 is about 4 mm for example. A depth (dimension in the radial direction of the roller) protruded from the outer circumferential part 205 of the protrusion 206 is about 3 mm for example, and a diameter (dimension in the radial direction of the roller) of the protrusion 206 is about 3 mm for example.

A fabrication method of the roller 10 will be described next. First, the roller body part 100 is prepared. The roller body part 100 is formed by processing a metal material such as aluminum alloy, etc., by machining using a lathe or a milling machine or the like. Next, the roller body part (metal core) 100 is placed as a core in an outer mold defining the outer shape of the rubber part 200, to thereby prepare a mold for molding the rubber part 200.

Next, vulcanization molding is performed by pouring a rubber material such as polyurethane for example into the mold, to thereby mold the rubber part 200. Thus, the roller 10 is fabricated having a structure in which the rubber part 200 is fitted into the roller body part 100. The entire body of the rubber part 200, that is, the rubber body part 201, the side extending part 203, and the outer circumferential part 205 of the rubber part 200 are integrally molded. After removing the roller 10 from the mold, required steps are performed such as a polishing step of polishing the outer circumference of the rubber part 200 and an assembly step of forming an assembly by making the shaft pass through the roller 10.

In the roller 10 of this embodiment, the roller body part 100 and the rubber part 200 are not fixed to each other by an adhesive agent. Namely, in the fabrication step of the roller 10 of this embodiment, prior to the step of pouring the rubber material into the mold, it is not necessary to previously apply the adhesive agent onto the surface in contact with the rubber part 200 of the roller body part 100.

The fabrication method of fixing the roller body part and the rubber part by the adhesive agent, is given as a comparative embodiment. In the comparative embodiment, it is necessary to provide the step of applying the adhesive agent onto the surface in contact with the rubber part of the roller body part. In this embodiment, such an adhesive agent application step is not required, and therefore the fabrication step of the roller can be simplified.

In the roller 10 of this embodiment, although the rubber part 200 and the roller body part 100 are not adhered to each other, the deviation or the fall-off of the roller body part 100 from the rubber part 200 can be suppressed, because the side extending part 203 is provided as described above.

In this embodiment, the rubber part 200 and the roller body part 100 are not adhered to each other. Therefore, there is an advantage as follows: if a failure occurs in the rubber part 200 in the molding step, a poor rubber part 200 can be easily removed from the roller body part 100, and the roller body part (metal core) 100 can be reused.

In this embodiment, the recess portion such as a groove 103, etc., is formed in the roller body part 100, and the side extending part 203, etc., is provided to suppress the deviation or the fall-off of the rubber part 200. Such a recess portion can be easily formed by a normal mechanical machining, similarly to forming the recess portion originally formed in the roller body part 100, such as a notch 101 into which the main part of the rubber body part 201 is fitted.

For example, the hole 106 into which the protrusion 206 of the outer circumferential part 205 is fitted, can be formed on the side edge portion of the large diameter part 115 by forming a (circular) hole extending in the thickness direction, using a drill or the like, so as to communicate with the inner surface of the recess portion 105 into which the outer circumferential part 205 is fitted, along the outer circumference of the roller.

Such a hole 106 formed on the side edge portion of the large diameter part 115 extending in the thickness direction, is the hole having a constant thickness if viewed in the thickness direction of the roller. However, if viewed in the radial direction of the roller, this is a recess portion having a structure in which the thickness becomes larger toward the inside. Therefore, the protrusion 206 fitted into the hole 106 has a structure in which the thickness becomes larger toward the inside (radial direction side) of the roller body part 100. Thus, the protrusion 206 can be hardly pulled-off radially outward.

To summarize the above description schematically, it can be considered that in the roller 10 of this embodiment, the rubber part 200 is configured so that the protrusion 202 of the rubber body part 201, the side extending part 203, and the protrusion 206 of the outer circumferential part 205, are added to the main part of the rubber body part 201 and the main part of the outer circumferential part 205 which are provided for activate the roller as a feed roller, as structures for suppressing the deviation or the fall-off of the rubber part 200, and particularly the deviation or the fall-off of the rubber body part 201.

Although the side extending part 203 has the effect of suppressing the deviation or the fall-off of the rubber body part 201 by the main part only, such an effect can be increased by further having the protrusion 204. Also, by forming the side extending part 203 into a ring shape, such an effect can be increased.

The outer circumferential part 205 is not required to be provided depending on a specification of the feed roller. When the outer circumferential part 205 is not provided, the structure of the roller body part 100 and the rubber part 200 in the large diameter part 115 can be a similar structure as the large diameter part 111 (in a symmetric relationship with the large diameter part 111) for example. The side extending part 203 of the rubber part 200 can also be provided on the side face of the large diameter part 115 side, similarly to the side face of the large diameter part 111 side. The side extending part 203 is not necessarily required to be provided on both side faces of the roller 10, and may be provided at least one side face.

Further, the outer circumferential part 205 may be provided in a ring shape over the whole circumference of the roller 10, or may be provided at a part of the roller 10 in the circumferential direction, or may be provided on a plurality of large diameter parts. When the outer circumferential part 205 is provided, the main part itself of the outer circumferential part 205 can be considered as the structure of suppressing the deviation or the fall-off of the rubber body part 201.

It is also acceptable that the side extending part 203 is formed as needed on the side face of the roller at the side where the outer circumferential part 205 is provided.

It is also acceptable that the roller structure provided with the large diameter part and the small diameter part as shown in this example, has another aspect in which the side extending part 203 is provided on the inside face of the large diameter part, other than the aspect of the abovementioned embodiment in which it is provided on the outside face of the roller. However, the fabrication is easier in the case of providing the side extending part 203 on the outside face of the roller, than the case of providing it on the inside face of the large diameter part of the roller.

It is not always necessary to add the abovementioned all structures as the structure of suppressing the deviation or the fall-off of the rubber body part 201, and a preferable structure can be suitably selected and added.

In the abovementioned embodiment, explanation is given for a case that the fabrication method of forming the rubber part 200 is provided by pouring the rubber material over the roller body part 100. However, it is also acceptable to employ a fabrication method of fitting the rubber part 200 into the roller body part 100 from outside as a separate body, as needed. However, it becomes difficult to fit the already molded rubber part 200 into the roller body part 100 from outside, by providing various structures of suppressing the deviation or the fall-off of the rubber part 200. Accordingly, it is easy and preferable to employ the fabrication method of molding the rubber part 200 by pouring the rubber material over the roller body part 100.

In the abovementioned embodiment, the feed roller used for the paper sheet separation mechanism is given for an example. However, the technique of suppressing the deviation or the fall-off of the rubber part described in the abovementioned embodiment, can be widely applied to the roller configured to have the rubber part on the outer circumference of the roller body part. For example, this technique can be applied to a pick-up roller, etc., used for the paper sheet separation mechanism.

The abovementioned embodiment shows an example of the roller structure in which the large diameter part and the small diameter part are provided. However, the abovementioned structure of suppressing the deviation or the fall-off of the rubber part, can also be provided to the roller having a structure in which the diameter is constant and the large diameter part and the small diameter part are not provided, depending on the specification of the roller.

The roller may have other structure (such as a counterbore part and the through hole, etc.) for satisfactorily functioning the roller, depending on the specification.

The present invention has been described above based on embodiments. However, the present invention is not limited thereto. For example, it is obvious for a skilled person, that various modifications, improvement, and a combination, etc. can be acceptable.

What is claimed is:

1. A roller, comprising:

a roller main body part; and a rubber part attached to the roller main body part, the rubber part comprising:

a rubber main body part provided on a part of an outer circumference of the roller main body part over an entire thickness of the roller main body part; and a side extending part extending on a side face of the roller main body part from a side face of the rubber main body part, wherein the roller main body part includes a first recess portion formed on the side face of the roller mam body part, into which the side extending part is fitted;

wherein the side extending part includes a first protrusion protruded to an inside of the roller main body part from the side face of the roller main body part, and the roller main body part includes a second recess portion into which the first protrusion is fitted, on an inner surface of the first recess portion into which the side extending part is fitted;

wherein the side extending part is formed into a ring shape;

wherein the rubber part further includes an outer circumferential part extending on the outer circumference of the roller main body part from an end portion of the rubber main body part in a circumferential direction, and the roller main body part further includes a third recess portion formed on the outer circumference of the roller main body part, into which the outer circumferential part is fitted;

wherein the outer circumferential part includes a second protrusion protruded to an inside of the roller main body part from the outer circumferential side of the roller main body part, and the roller main body part includes a fourth recess portion into which the second protrusion is fitted, on an inner surface of the third recess portion into which the outer circumferential part is fitted; and wherein the rubber main body part includes a third protrusion protruded to an inside of the roller main body part, and the roller main body part includes a fifth recess portion into which the rubber main body part is fitted, and includes a sixth recess portion into which the third protrusion is fitted, on an inner surface of die fifth recess portion into which the rubber main body part is fitted.

2. The roller according to claim 1, wherein the roller main body part and the rubber part are in contact with each other not through an adhesive agent.

3. A roller, comprising:

a roller main body part; and a rubber part attached to the roller main body part, the rubber part comprising:

a rubber main body part provided on a part of an outer circumference of the roller main body part over an entire thickness of the roller main body part; and a side extending part extending on a side face of the roller main body part from a side face of the rubber main body part, wherein the roller main body part includes a first recess portion formed on the side face of the roller main body part, into which the side extending part is fitted;

wherein the side extending part includes a first protrusion protruded to an inside of the roller main body part from the side face of the roller main body part, and the roller main body part includes a second recess portion into which the first protrusion is fitted, on an inner surface of the first recess portion into which the side extending part is fitted;

wherein the rubber part further includes an outer circumferential part extending on the outer circumference of the roller main body part from an end portion of the rubber main body part in a circumferential direction, and the roller main body part further includes a third recess portion formed on the outer circumference of the roller main body part, into which the outer circumferential part is fitted; and wherein the outer circumferential part includes a second protrusion protruded to an inside of the roller main body part from the outer circumferential side of the roller main body part, and the roller main body part includes a fourth recess portion into which the second protrusion is fitted, on an inner surface of the third recess portion into which the outer circumferential part is fitted.

4. The roller according to claim 3, wherein the roller main body part and the rubber part are in contact with each other not through an adhesive agent.

* * * * *